US007543901B2

(12) United States Patent
Snyder et al.

(10) Patent No.: US 7,543,901 B2
(45) Date of Patent: Jun. 9, 2009

(54) FASTER WARM-UP, LOWER ENERGY, AND QUIETER MODES FOR SOLID INK PRINTERS

(75) Inventors: Trevor J. Snyder, Newberg, OR (US); Amy R. Bartlett, Tigard, OR (US); Bo Wu, Wilsonville, OR (US); Randall R. Bridgeman, Tualatin, OR (US); Andrew W. Hill, Portland, OR (US); Jennifer Miyamoto, Portland, OR (US); Jule W. Thomas, Jr., West Linn, OR (US); Donald R. Titterington, Newberg, OR (US); Steven V. Korol, Dundee, OR (US); David L. Knierim, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 277 days.

(21) Appl. No.: 11/270,214

(22) Filed: Nov. 8, 2005

(65) Prior Publication Data

US 2007/0103523 A1 May 10, 2007

(51) Int. Cl.
*B41J 29/38* (2006.01)

(52) U.S. Cl. ..... 347/17; 347/99

(58) Field of Classification Search ..... 347/99, 347/103

See application file for complete search history.

(56) References Cited

U.S. PATENT DOCUMENTS

| | | | | |
|---|---|---|---|---|
| 5,041,161 | A * | 8/1991 | Cooke et al. | 347/99 |
| 5,820,275 | A * | 10/1998 | Crawford et al. | 400/185 |
| 6,390,617 | B1 * | 5/2002 | Iwao | 347/102 |
| 2001/0055047 | A1 * | 12/2001 | Ohsawa et al. | 347/55 |
| 2002/0085054 | A1 * | 7/2002 | Tokie | 347/15 |
| 2004/0095421 | A1 * | 5/2004 | Hickman et al. | 347/41 |
| 2005/0110856 | A1 * | 5/2005 | Mouri et al. | 347/103 |

* cited by examiner

*Primary Examiner*—Matthew Luu
*Assistant Examiner*—Justin Seo
(74) *Attorney, Agent, or Firm*—Marger Johnson & McCollom, P.C.

(57) ABSTRACT

A method of operating a printer turns off a support structure heater when the printer enters standby mode. The print head is then moved away from an intermediate transfer surface supported by a support structure. Heat settings used to heat a print head are then varied to heat the print head and the support structure. Another method of operating a printer turns off a support structure heater when the printer enters standby mode and holds a print head adjacent to an intermediate transfer surface while the printer is in standby mode.

6 Claims, 7 Drawing Sheets

FASTER WARM-UP, LOWER ENERGY, AND QUIETER MODES FOR SOLID INK PRINTERS

BACKGROUND

Offset, solid ink printers have many advantages over traditional ink jet technology. They generally have higher print speed, better color gamut, water fast results, can use many different types of media, etc. A solid ink printer typically uses a solid ink that is melted and jetted onto an intermediate transfer surface prior to being transferred and fixed onto the media. A printer as that term is used here could be any device using a print engine, including copiers, fax machines, printers, multi-function devices (MFDs) that can print, fax, copy and scan, etc. The intermediate transfer surface may be referred to as a drum for convenience, with no intention of limiting the transfer surface to a drum configuration. The intermediate transfer surface may be supported by a drum or a belt.

In solid ink printers, the ink and the transfer surface must be at a relatively high temperature compared to aqueous ink jet printers. In order to avoid long warm-up and purging processes that result from solidified inks, the print head generally keeps the ink molten when not in continuous use. Elevated temperatures tend to consume more power. Lower temperatures use less power, but also lengthen the amount of time before the printer is ready to print again.

SUMMARY

An embodiment is a method of operating a printer that turns off a support structure heater when the printer enters standby mode. The print head is then moved away from an intermediate transfer surface supported by a support structure. Heat settings used to heat a print head are then varied to heat the print head and the support structure.

Another embodiment is a method of operating a printer that turns off a support structure heater when the printer enters standby mode and holds a print head adjacent to an intermediate transfer surface while the printer is in standby mode.

DETAILED DESCRIPTION

Figure 1:
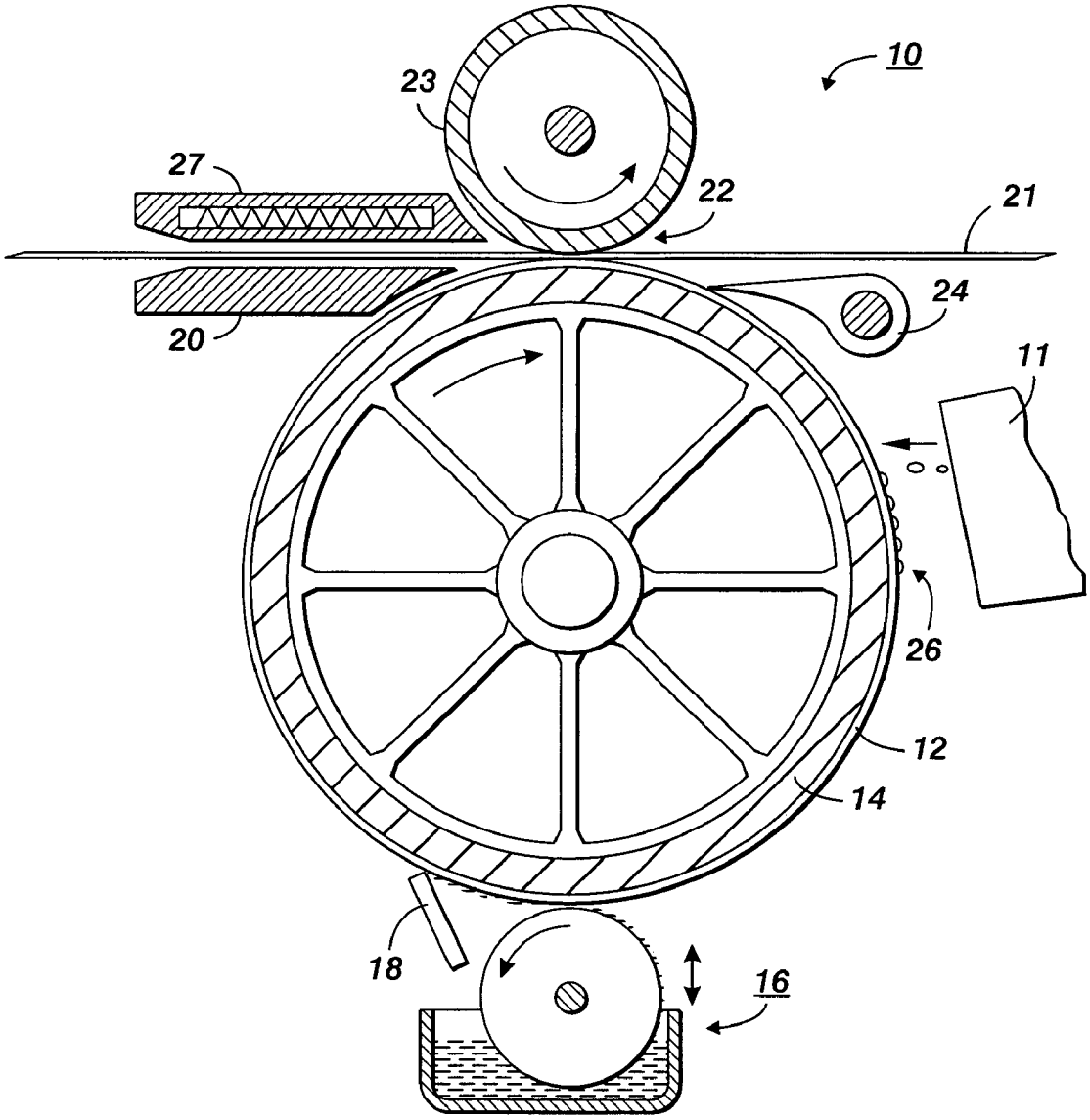
FIG. 1 shows a schematic of a solid ink printer.

FIG. 1 shows an example of a printer 10. The term printer as used here applies to any print engine, whether it is part of a printer, copier, fax machine, scanner or a multi-function device that has the capability of performing more than one of these functions. The printer has a print head 11 that deposits ink dot 26 on an intermediate transfer surface 12 to form an image. The support structure 14 supports the intermediate transfer surface 12. For ease of discussion, the support structure will be referred to here as a drum, but may be a drum, a belt, etc. The intermediate transfer surface 12 may be a liquid applied to the support structure 14 by an applicator, web, wicking apparatus, metering blade assembly 18 from a reservoir 16.

The ink dots 26 form an image that is transferred to a piece of media 21 that is guided past the intermediate transfer surface by a substrate guide 20, and a media pre-heater 27. In solid ink jet systems, the system pre-heats the ink and the media prior to transferring the image to the media in the form of the ink dots. A pressure roller 23 transfers and fixes (transfixes) the ink dots onto the media at the nip 22. The nip is defined as the contact region between the media and the intermediate transfer surface. It is the region in which the pressure roller compresses the media against the intermediate transfer surface. This pressure, combined with elevated temperatures, achieves the transfer of the image. One or more stripper fingers, such as 24, may assist in lifting the media away from the intermediate transfer surface.

Generally, solid ink jet systems heat the drum, the ink and the media to ensure proper transfer of the image onto the media. A drum heater typically heats the drum and a separate print head heater heats the print head in which the ink is contained. These heaters consume more power at higher temperatures, and power consumption is especially high when at the operating temperatures. Lowering the power to the heaters allows the various components to cool off during periods of inactivity, but that in turn increases the re-start time for the system as the inks and drum both need to resume their operating temperature. In addition, at a specific temperature—typically close to the temperature the ink will solidify—the print head may need to be purged. This is done to ensure all the jets are refilled and ready to print without any negative effects on image quality. Managing this tradeoff between power consumption and start-up time presents several issues.

Further, environmentally sensitive and market place regulations now call for office equipment, such as reproduction machines and multi-function devices, to be more energy efficient. Such environmental regulations or requirements for office products are covered in the United States under what is currently called the "Energy Star Program", and under various other similar programs in Europe and elsewhere. Such similar programs include "New Blue Angel" (Germany), "Energy Conservation Law" (Japan), "Nordic Swan" (North Europe), and "Swiss Energy Efficiency Label" (Switzerland).

These environmental programs as well as the market (manufacturer/customer) set forth reduced power consumption level requirements and requisite times to enter these modes. These reduced power consumption modes such as standby, low power, power saver, energy saver, sleep, etc., vary in power levels and consume less power than in 'Ready' mode, but greater than when in 'Off' mode.

When the machine is in a reduced power consumption mode as required to meet these environmental program and/or market requirements, recovery times are increased. Timely and satisfactory recovery from these significantly reduced power consumption levels back to the operating temperatures are important to a customer, but can be difficult.

In current implementations, upon entering a reduced power consumption mode, the print head is tilted away from the drum. Additionally, the print head is insulated in order to reduce the power. The insulation of the print head slows the flow of heat from the head, which reduces power consumption. The temperature is held at the lowest possible temperature that does not require a purge prior to printing. The recovery time for this type of approach is relatively large. Current products can take 3 to 3.5 minutes.

Figure 2:
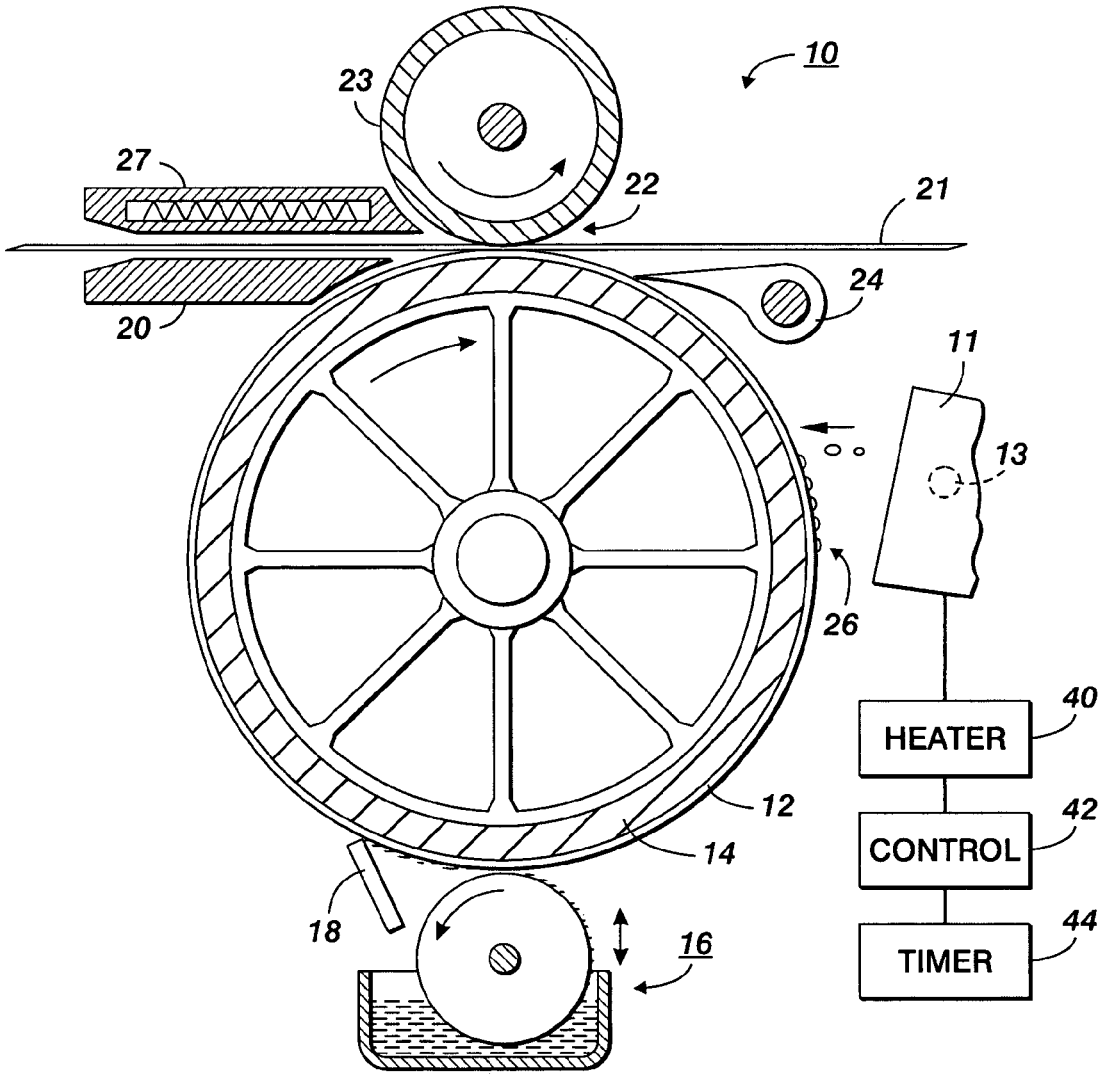
FIG. 2 shows a printer having a variable temperature controlled print head.

An alternative approach also has the head tilted away from the drum. However, instead of using a constant head temperature, a specific algorithm is used to control the head temperature as a function of time. The head is brought below the temperature, which would normally result in a purge, but is held there for only a finite amount of time. The head is then brought up in temperature for a second amount of time before returning to the lower temperature again. A printer employing one approach of applying power to the print head is shown in FIG. 2.

The printer of FIG. 2 has the print head 11 with its mounting 13, which will be discussed in more detail further, a print head heater 40, which in turn has a control 42 and a timer 44. The print head heater 40, control 42 and timer 44 may all reside in the print head, all reside separately from the print head, or any combination thereof. The controller 42 may manipulate operation of the print head heater 40 in conjunction with the timer 44 to allow the inks to be held at a lower standby temperature most of the time. The controller 42 could then turn on the print head heater to allow the inks to heat up momentarily before reverting to the lower standby temperature again.

Figure 3:
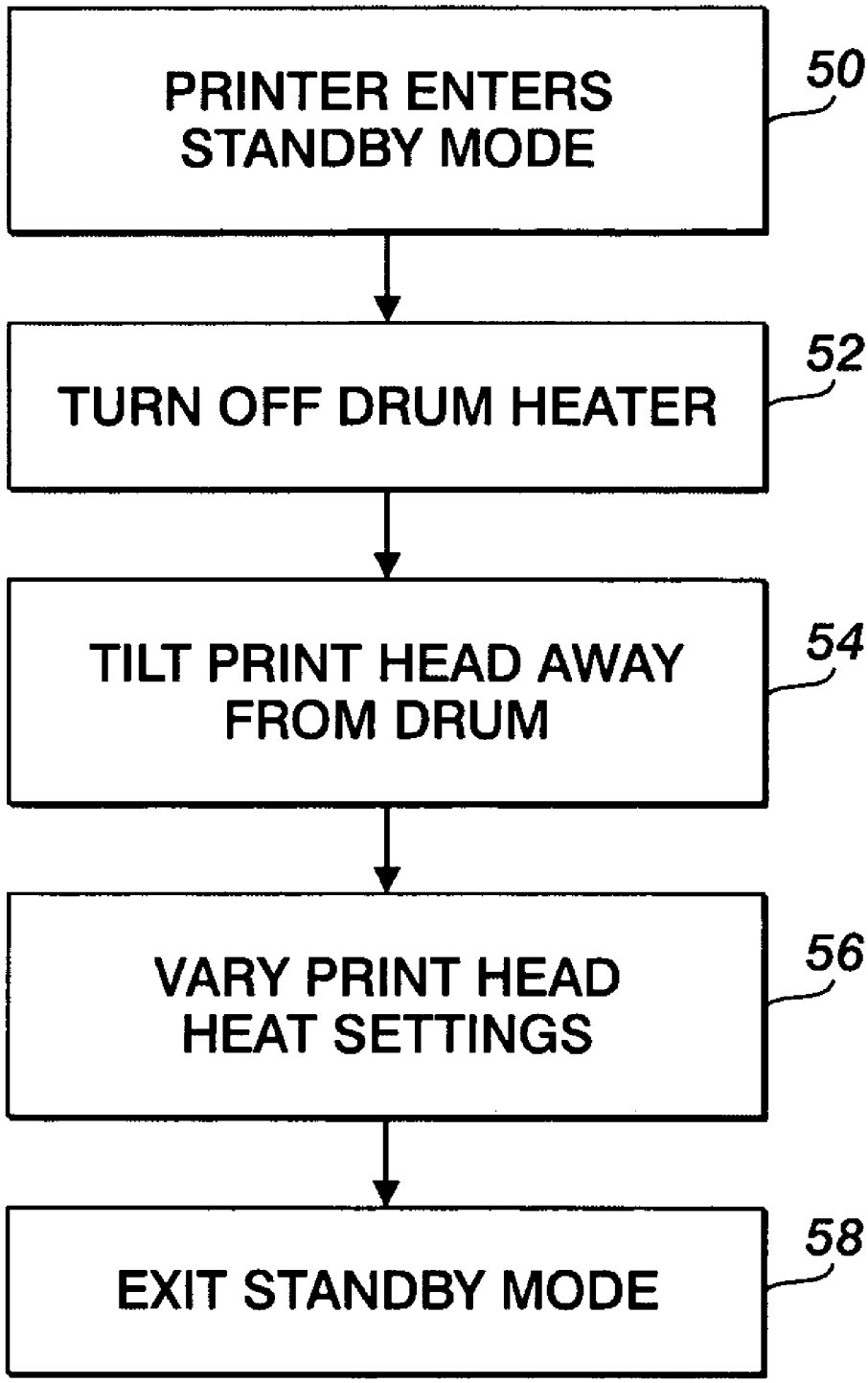
FIG. 3 shows a flowchart of an embodiment of a method of operating a printer.

A method for operating the print head in standby mode is shown in flowchart form in FIG. 3. Upon the printer entering the standby mode at 50, the drum or support structure heater is turned off at 52. The print head is then rotated or tilted away from the intermediate transfer surface at 54 to the position shown in FIG. 2. This is similar to current products. Once the head reaches its standby position, the heater control 42 would control the heater according to the timer 44 to vary the print head heat settings at 56 in FIG. 3. This would continue until the printer exits the standby mode at 58. The subsequent processes that occur after the printer exits the standby mode will be discussed in more detail later.

The variations of the print head heat settings may occur in many different modes. For example, in a first mode, the temperature is moved up and down along a ramp between two temperatures, say between 70° C. and 90° C. In a second mode, the controller sets the temperature at a first temperature for a first period of time and then raised the temperature to a higher temperature for a second period of time shorter than the first. For example, the print head heater can hold the inks at 80° C. for two hours and then raise the temperature to 90 C. The exact temperatures, mode and times would depend upon the specific ink being used. However, analysis and experimentation have shown that the temperature manipulation saved power.

As an alternative to tilting the head away, the head may be left adjacent to the intermediate transfer surface in the standby mode. This has the advantage of providing the drum with heat that is radiated from the print head, allowing the drum to maintain a higher temperature as well. This approach uses slightly higher power, but achieves a reduced restart time from standby.

Figure 4:
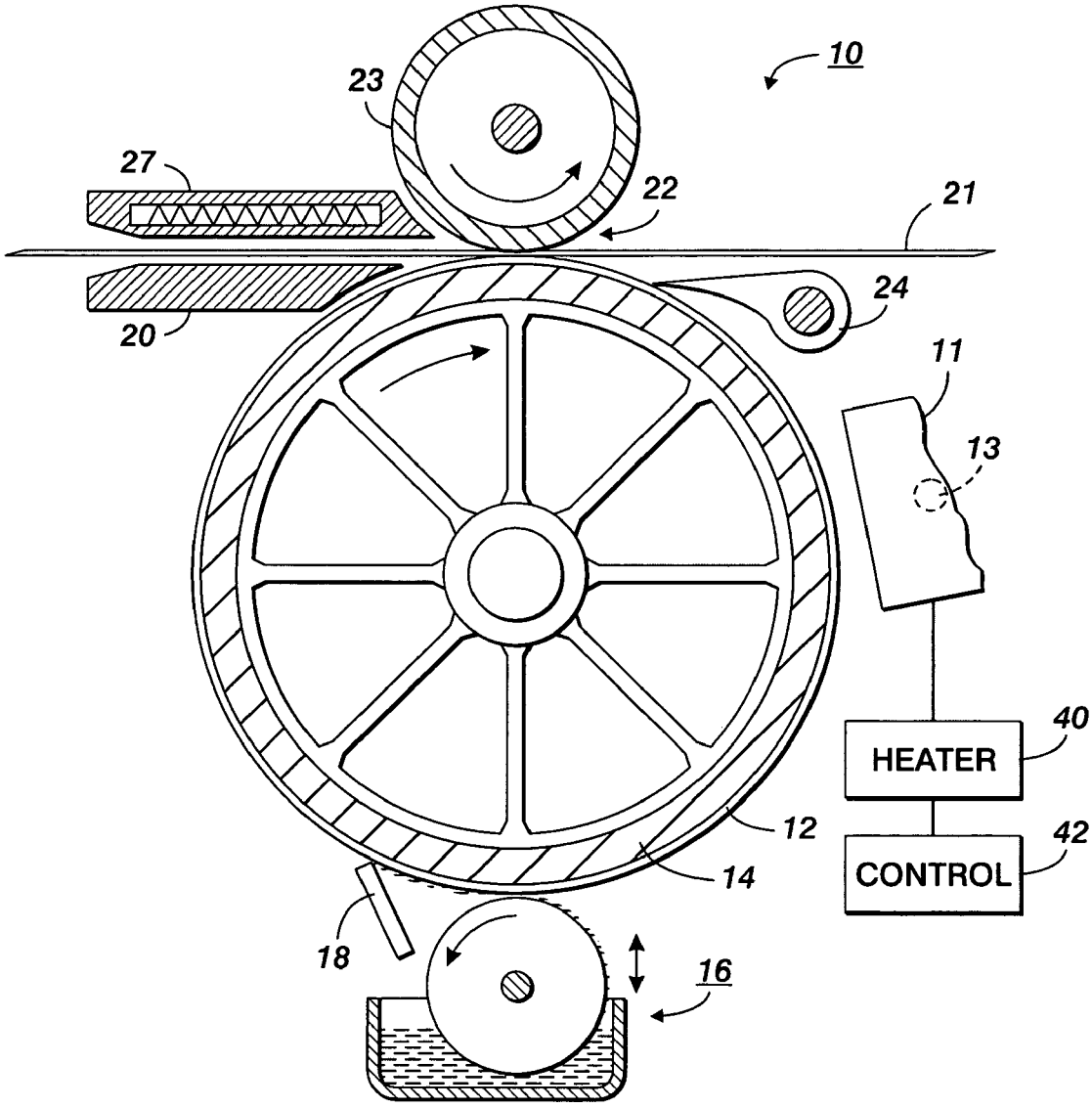
FIG. 4 shows a printer having a print head mounted adjacent to an intermediate transfer surface.

As noted above, the waste heat from the print head assists in maintaining the drum temperature to avoid using the drum heater. Instead of tilting the print head away from the drum in standby mode, the printer leaves the head tilted near the drum when in standby mode to purposely absorb the heat from the print head. As mentioned above, current printers generally tilt or move the print head away from the drum in standby mode. This embodiment holds the print head in the 'printing' position even during standby mode. A printer employing this approach is shown in FIG. 4.

Leaving the print head tilted towards the intermediate transfer surface, which is supported by the drum, allows the intermediate transfer surface to absorb the waste heat from the print head to maintain its temperature while avoiding use of the drum heater (not shown). While this may result in higher power consumption at the print head, the overall system consumption may be lower.

Figure 5:
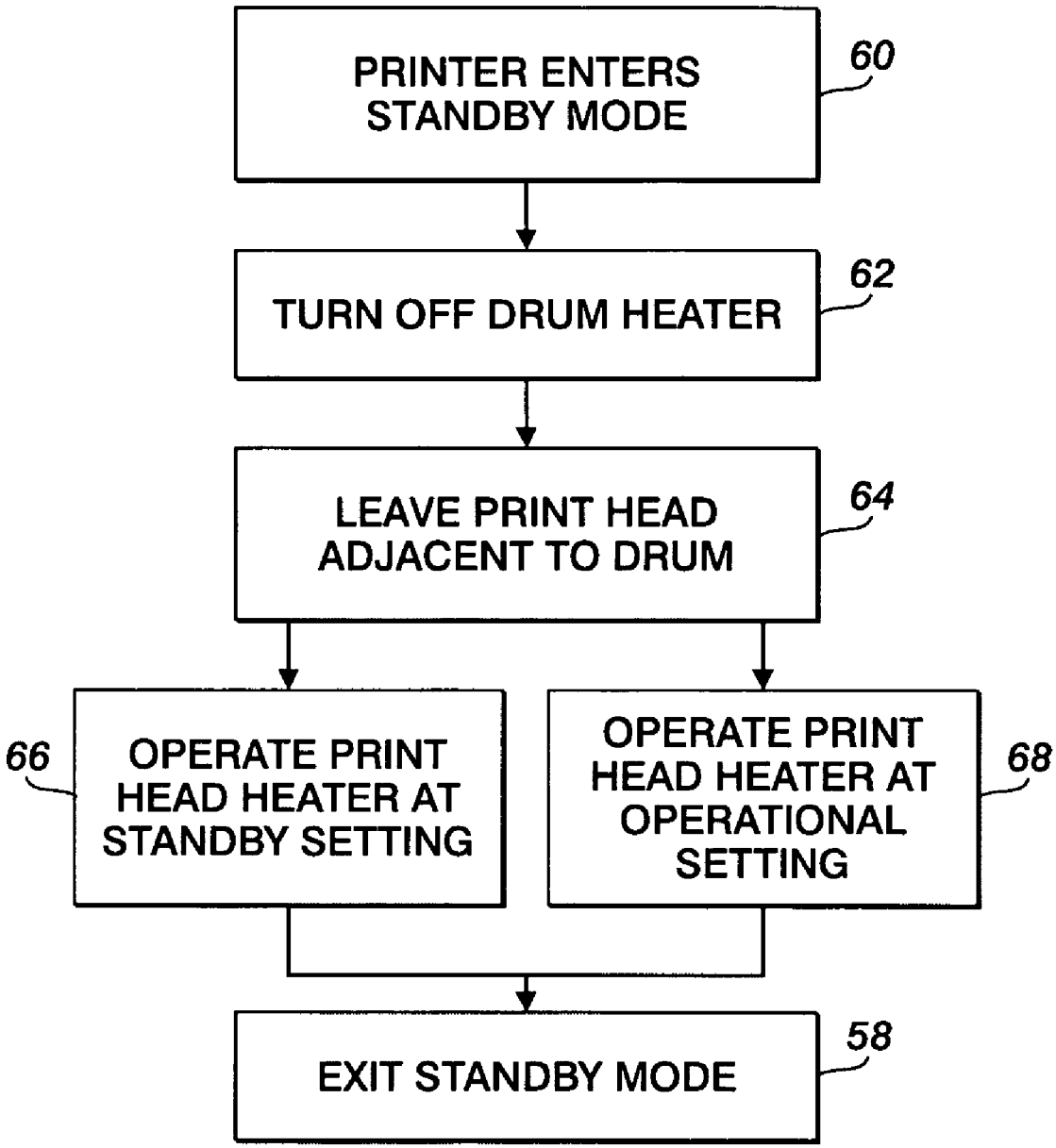
FIG. 5 shows a flowchart of an alternative embodiment of a method of operating a printer.

A process for operating a printer with the head remaining in the print position in standby mode is shown in FIG. 5. The printer enters standby mode at 60. The drum heater is turned off at 62, and the print head is left in its printing position near the drum 64. These two processes may occur simultaneously or in reverse order. From this position, the print head may be operated in many different modes. For example, at 66, the print head heater is operated at its standby setting, with the drum receiving heat from the print head. This mode has a slower restart time, as the drum will take time to achieve its operating temperature, but there is significant power savings from turning off the drum heater.

Alternatively, the print head heater may be operated at its typical operational setting at 68. This may be referred to as the 'always on' mode, as the print head heater power is never reduced. The resulting standby temperature of the drum is raised from the previous embodiment, as there is more waste heat from the print head. This mode has a faster restart time, but the power savings are impacted by the higher power consumption by the print head heater.

Figure 6:
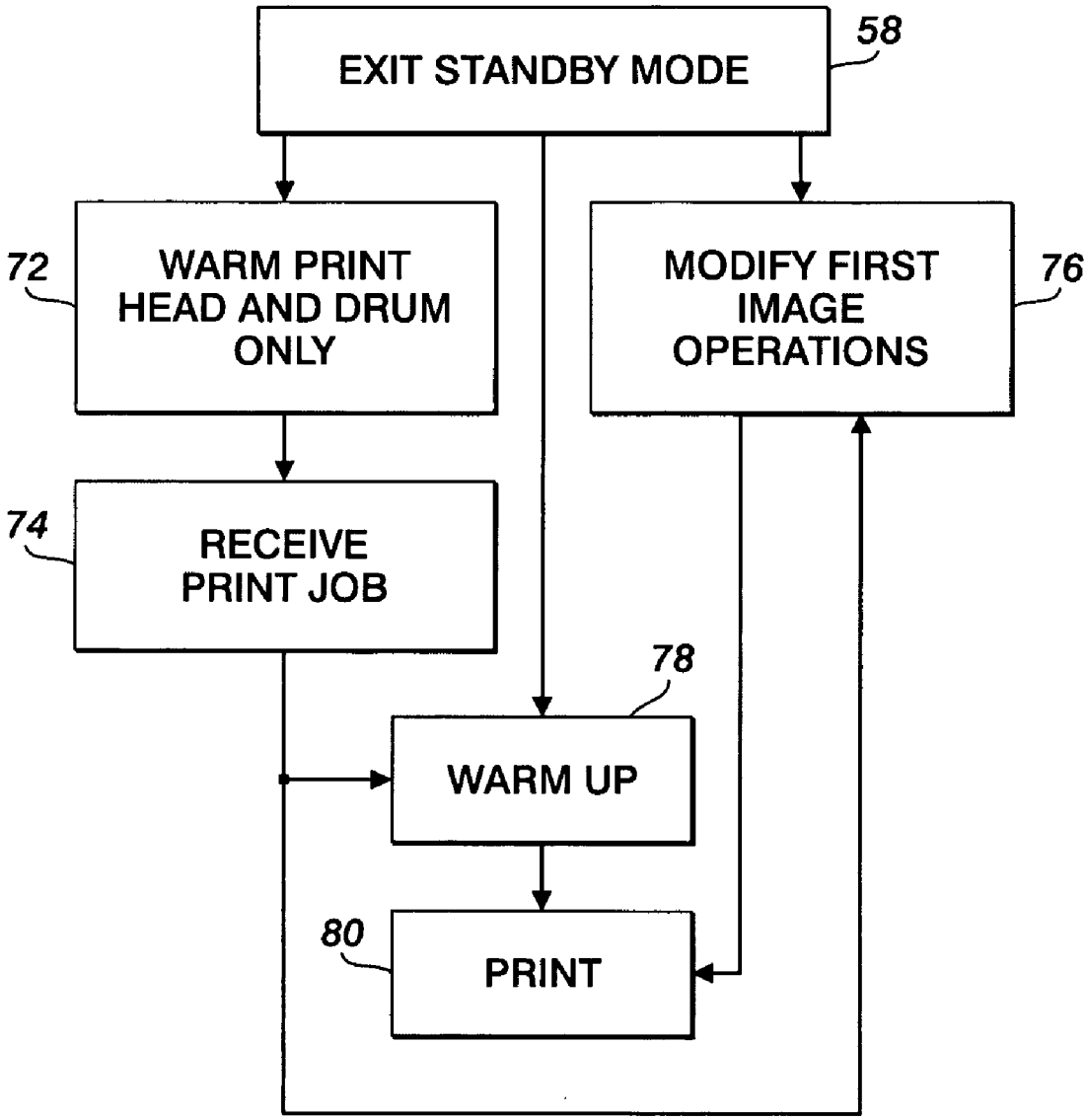
FIG. 6 shows a flowchart of an embodiment of a method of operating a printer upon exiting standby mode.

Assuming similar heater power allocations for the drum and head as implemented in current products, the drum actually can take the longest to come to operating temperature from the non-operating modes when the printer exits standby. An embodiment of this process is shown in FIG. 6, beginning when the printer exist standby mode at 58. The print head jet stack takes less time to come to its operating temperature compared to the print head reservoir. The print head jet stack is the portion of the print head that holds the conduits in which the ink is transferred to the intermediate transfer surface, and possibly other structures. The reservoirs are generally arranged on the other side of the jet stack from the intermediate transfer surface and contain the inks. The jet stack takes less time to warm than the reservoirs. Therefore, these modes can also include the ability to operate the print head when only the jet stack is at temperature, and not necessarily the ink reservoirs, with such adjustments including but not limited to, slowing the operating frequency, changing the print head driving voltage, or changing the print head waveform, accepting only typical low-fill (i.e. text) images until the reservoir is warm, etc.

Similarly, these modes can also include printing an image when the drum may be at a slightly reduced temperature from its normal operating temperature. If faster warm-up can be achieved, it would be desirable to adjust the print process such that the first print out is as fast as possible with acceptable print quality, with such adjustments including slower transfix velocity, higher media preheat temperature, etc. This is shown at 76 in FIG. 6. It must be noted that this is referred to as modified first image operations, as it is assumed that all the printer components will achieve normal operating temperatures within the first image being printed. It is possible that the modified operating parameters may require more than the first image before achieving operational temperatures.

In addition, the warm up may be controlled based upon other factors such as noise. For example, current print systems come out of power save mode to standby mode when the system controller or processor predicts a user is going to make a print output. In many cases the printer comes out of power saver not due to receiving a print job, but due to an 'intelligent ready' process. Intelligent ready is a feature that tracks customer usage and anticipates when a customer will print a job and readies the printer prior to receiving the job. This process may be controlled to reduce noise.

There are many systems in the current solid ink printer that make noise when the printer is activated. These include the electronics cooling fan, the drum fan, the head tilting mechanisms, and the print head homing mechanism. Every time the printer comes out of the power saver mode, it must make these noises. The control of the printer modes may also include the ability to warm the head and drum only when restarting in response to an intelligent ready process, shown at 72 in FIG. 6. It can do this nearly silently, or with great noise reduction. Only when the printer actually receives a print job at 74 will the printer finish its startup as shown at 78. Since most of the time required to restart is due to heating the drum and print head, this will achieve nearly all the benefits of intelligent ready, but without the problem of noise when there are no current print jobs. It is also possible that upon receiving the print job at 74, the process is combined with the modified first image operating parameters at 76, discussed above. Regardless of the path taken, once the printer is ready to print either in standard operating mode or with modified first image operations, the printer prints at 80.

Holding the print head adjacent the drum whenever the printer does not print has advantages in other states than the power-saver or standby state. For example, in an 'always on' mode, in which the printer does not enter the standby, power-saving mode, the power applied to the print head may avoid the use of the drum heater. The system applies no power to the drum, only using the waste energy from the print head to heat the drum.

In order to take advantage of placing the head adjacent to the drum, the head must be mounted in such a manner as to be movable as shown by mounting 13 in FIG. 2. The head would move against the drum when imaging and for certain power saver modes and would move away only for purging and when moving the printer. The mounting could be a movable bracket, a swivel, an arm, etc. No limitation of the mounting is intended nor should be implied by any particular example given here. One such example is shown in FIG. 7.

Figure 7:
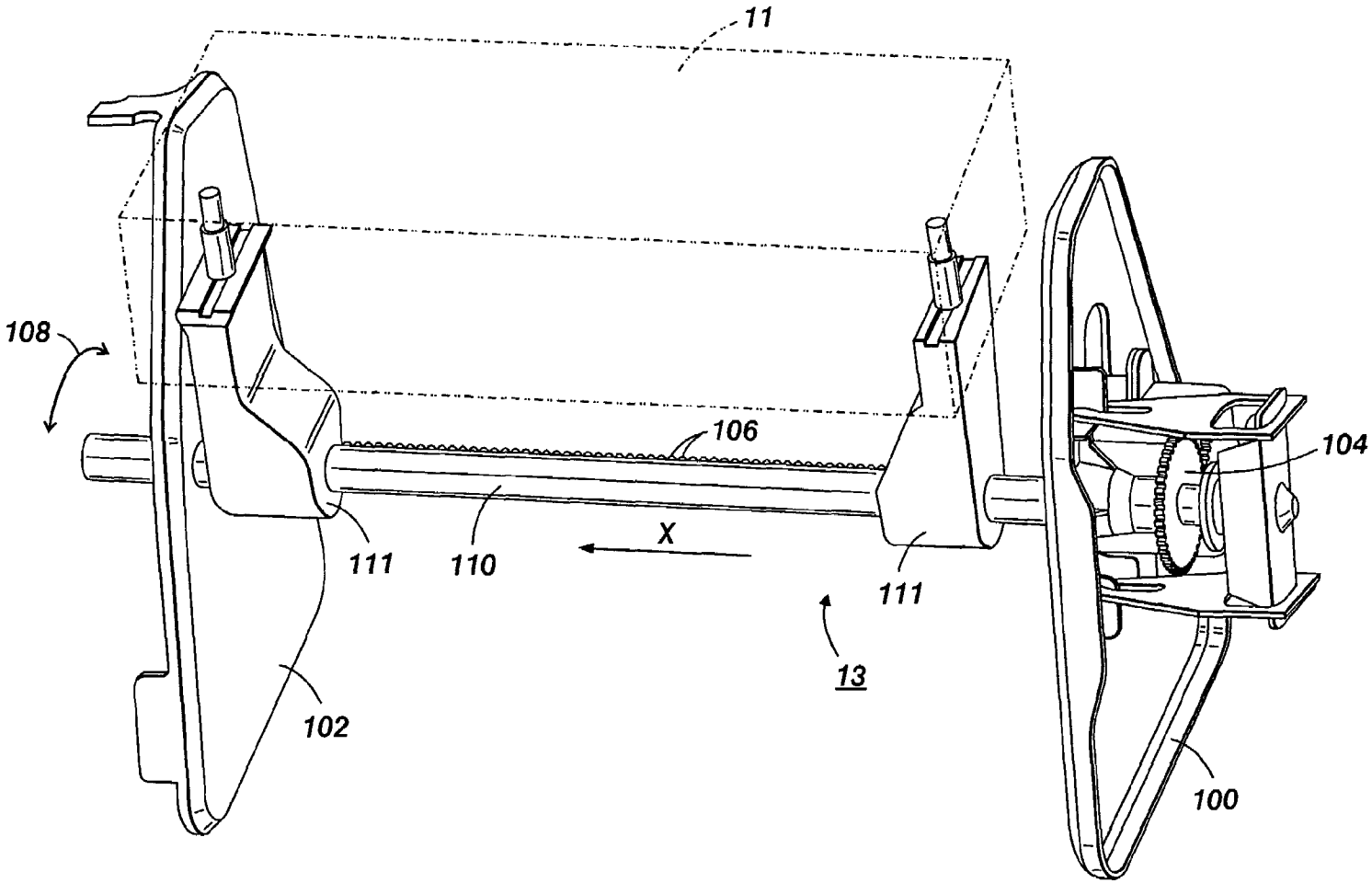
FIG. 7 shows a rotatable mounting for a print head.

In FIG. 7, the mounting 13 comprises print head supports 111 attached to shaft 110, bearing brackets 100 and 102 which allow shaft 110 to rotate and slide, bearing bracket 102 including a lead screw drive mechanism. The lead screw drive mechanism includes a motor coupled to a lead screw nut 104 which drives a lead screw (not shown) attached to the right end of shaft 110. Rotation of lead screw nut 104 causes translation (sliding) of shaft 110 along the x-axis. Supports 111 and print head 11 translate with shaft 110. Bearing brackets 100 and 102 also allow rotation of shaft 110, thus allowing the print head to be tilted towards the intermediate transfer surface or away from it as shown in FIGS. 1, 2 and 4.

In this manner, a printer may achieve optimum power savings and warm-up times in either the standby or always on modes by holding the print head adjacent to the intermediate transfer surface such as a drum. Further, in modes where the print head may tilt away from the drum, a printer may save power by fluctuating the print head temperature between a higher and lower temperature. The printer may achieve the fluctuation in a ramping fashion or by holding the head at a first lower temperature for a first period of time and then raising the temperature to a second higher temperature for a second period of time shorter than the first period of time, as examples.

It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A printer, comprising:

a print head to transfer melted ink on an intermediate transfer surface disposed on a support structure;

a mounting configured to position the print head in at least a first position adjacent to the intermediate transfer surface and a second position tilted away from the intermediate transfer surface, wherein the print head provides heat to the intermediate transfer surface when in the first position;

a support structure heater to heat the intermediate transfer surface;

a print head heater to heat the print head; and a controller to control the print head heater to vary temperature of the print head from a full power mode to reduced power mode, wherein the reduced power mode comprises at least two preset temperatures and the controller is configured to control the print head heater to alternate the temperature of the print head between the at least two preset temperatures.

2. The printer of claim 1, further comprising a timer configured to determine a duration of the alternating between the at least two preset temperatures.

3. The printer of claim 1, the controller to vary temperature of the print head between two temperatures in the reduced power mode.

4. The printer of claim 1, the controller further to cause the support structure heater to be turned off when in the reduced power mode.

5. The printer of claim 3, wherein the two temperatures further comprise a first temperature just below a melting point of the ink and a second temperature above the melting point of the ink.

6. The printer of claim 3, where in the controller varies the temperature of the print head between a first, lower temperature for a first predetermined period of time and a second, higher temperature for a second predetermined period of time shorter than the first period of time.

* * * * *